United States Patent [19]

Ahnström

[11] Patent Number: 4,689,261

[45] Date of Patent: Aug. 25, 1987

[54] ROUNDED CORRUGATED SHEET AND METHOD AND APPARATUS FOR ITS MANUFACTURE

[76] Inventor: Ove Ahnström, Barkvägen 8, S-360 51 Hovmantorp, Sweden

[21] Appl. No.: 720,305

[22] Filed: Apr. 5, 1985

[51] Int. Cl.[4] ..... B32B 3/28; B32B 15/00; B21D 5/14; B21D 5/16; B21B 15/00

[52] U.S. Cl. ..... 428/182; 428/183; 72/177; 72/179; 72/180

[58] Field of Search ..... 428/182, 183; 72/177, 72/179, 180

[56] References Cited

U.S. PATENT DOCUMENTS

| | | | |
|---|---|---|---|
| 3,009,511 | 11/1961 | Bouef, Sr. | 153/77 |
| 3,690,137 | 9/1972 | Cookson | 72/180 |
| 3,859,832 | 1/1975 | Siegwart | 72/180 |
| 4,080,815 | 3/1978 | Foster | 72/168 |
| 4,144,369 | 3/1979 | Wass | 428/183 |
| 4,154,077 | 5/1979 | Cotter | 72/166 |
| 4,215,488 | 8/1980 | Donabedian | 34/238 |

FOREIGN PATENT DOCUMENTS

| | | |
|---|---|---|
| 31822 | 3/1981 | European Pat. Off. . |
| 2229161 | 1/1974 | Fed. Rep. of Germany . |
| 0048756 | 5/1974 | Japan . |

*Primary Examiner*—John E. Kittle
*Assistant Examiner*—Patrick J. Ryan
*Attorney, Agent, or Firm*—Browdy and Neimark

[57] ABSTRACT

The present invention relates to rounded corrugated sheeting (4) whose profile exhibits crest portions (5), flanks (6), and bottom portions (7). The crest portions (5) are located on the concave side of the rounded sheet and are provided with grooves formed by pressing during rounding of the sheeting. The grooves form ribs (10) on the convex side of the sheet. In the rounding of the sheet, the material present in the crest-portions (5) of the sheet (4) is distributed in a manner which facilitates rounding and counteracts the formation of folds or wrinkles in the crest portions (5), and prevents other forms of damage.

9 Claims, 11 Drawing Figures

Fig. 1
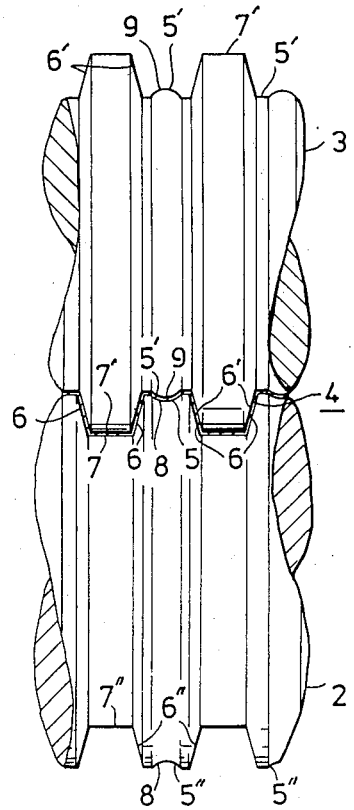
Fig. 2
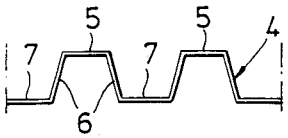
Fig. 5
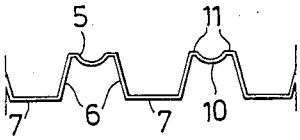
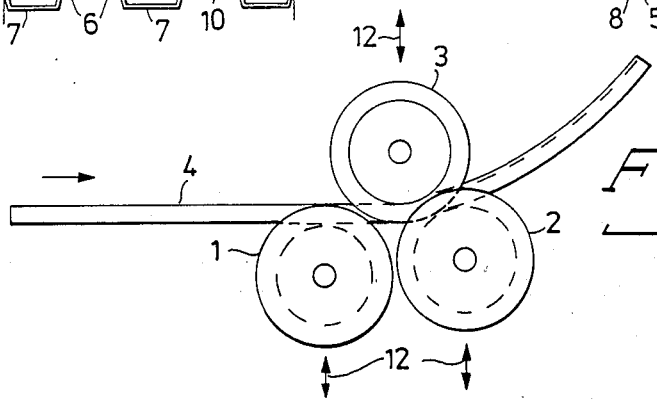
Fig. 3
Fig. 4
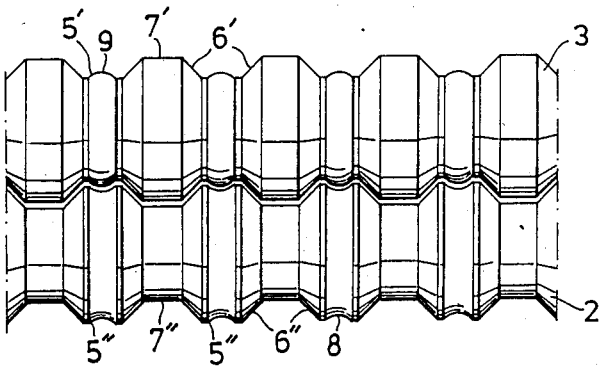

ROUNDED CORRUGATED SHEET AND METHOD AND APPARATUS FOR ITS MANUFACTURE

The present invention relates to rounded corrugated plate or sheet having a profile which exhibits crest portions, flanks and bottom portion. The invention also relates to a method for producing rounded corrugated plate or sheet and to a bending machine therefor. For the sake of simplicity the various aspects of the invention will be described with reference to sheet, although it will be understood that by sheet is also meant plate.

In particular, the invention relates to the working of corrugated metal sheets whose undulations have a truncated configuration, or the configuration of a parallel trapezium, when seen in profile, preferably sheets which are made of aluminium or an alloy thereof. It will be understood, however, that the invention can also be applied with sheets made of steel or other materials.

Such sheets are used, inter alia, in the manufacture of tubes of large diameter and the building of roofing structures, etc.

The majority of present day bending machines intended for the aforesaid purpose are unable to bend, for example, relatively thin sheet, to provide small radii of curvature, and to bend, for example, corrugated sheet of trapezium-shaped profile, without creating folds or creases in the materials, or without cracking the material or damaging it in a way which creates faults therein.

Consequently, a first object of the present invention is to provide rounded corrugated sheet which, (a) is longitudinally rigid, (b) is able to withstand high stresses and strains, even when exhibiting curves of small radius and/or when having extremely small thickness, and (c) which is free from cracks, folds and deformations. Further objects of the invention are to provide a bending machine and a method by means of which corrugated sheet can be rounded to small radii of curvature and thin sheet can be shaped in a reliable manner while avoiding deformation or damage to the sheet. It shall also be possible to bend the sheet with such care that surface-treated sheet, e.g. enamelled or painted sheet, can be rounded without damaging the coating thereon.

This first object is achieved in accordance with the invention with a rounded corrugated sheet of the aforementioned kind wherein the bottom portions located on the concave side of the sheet have provided therein grooves which forms ribs on the concave side of the rounded sheet, said ribs preferably being of rounded cross section. The said further objects are achieved by means of a bending machine comprising at least two first rolls having a profile corresponding substantially to the profile of said sheet, and at least one opposing roll having a profile which is substantially the inverse of the aforementioned roll profile, characterized in that the bottom portions of at least one of said first rolls and the corresponding bottom portion of the opposing roll have arranged thereon mutually engaging, circumferentially extending grooves and ridges, and with the aid of the method comprising pressing into the bottom portions of the corrugations located on the concave side of a rounded sheet grooves which form ribs extending toward the convex side of said sheet.

Additional characterizing features of the invention and advantages afforded thereby are defined in the claims and will be evident from the following description made with reference to the accompanying drawings. Hereinafter, embodiments of the invention will be described by way of example with reference to the schematic drawings, in which:

FIG. 1 is a schematic front view of a roll assembly according to the invention;

FIG. 2 is an end view of a corrugated sheet prior to rounding said sheet;

FIG. 3 is a side view of the roll assembly illustrated in FIG. 1 during a sheet rounding operation;

FIG. 4 is a front view of a roll pair designed in accordance with the invention;

FIG. 5 is an end view of a rounded corrugated sheet produced in accordance with the invention;

Figure 6:
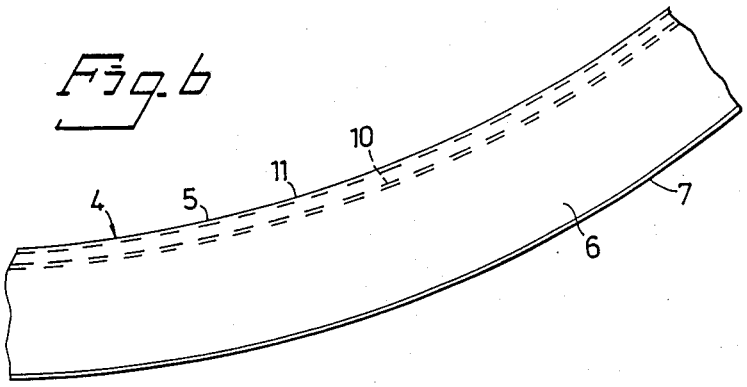
FIG. 6 is a partial side view in larger scale of a rounded corrugated sheet according to the invention.

As shown in FIGS. 1–5, the machine according to the invention comprises mainly three rolls 1,2 and 3, of which two mutually similar rolls 1,2 are located substantially horizontally one after the other, as shown more clearly in FIG. 3. The rolls 1–3 have a profile which corresponds substantially to the desired profile of sheet to be rounded, in particular a corrugated metal sheet 4 of trapezium-shaped profile, as illustrated in FIG. 2. When seen in cross-section, the trapezium-shape corrugations of the sheet exhibit crests 5, flanks 6 and bottoms 7. The crests 5 and bottoms 7 may be mutually identical, as in the illustrated embodiment, to provide a symmetrical profile.

As beforementioned, the peripheral surfaces of the rolls 1,2 and 3 each has a general profile corresponding to the desired shape of the sheet to be rounded, wherewith the rolls 1 and 2, which are located below roll 3, exhibit trapezium crests 5″, trapezium flanks 6″ and trapezium bottoms 7″, while the overlying roll 3 has an inverted configuration with trapezium bottoms 5′, trapezium flanks 6′ and trapezium crests 7′.

In accordance with the invention, there is provided on each crest surface circumferentially around the rolls 1 and 2 a groove 8, which is preferably of shallow, rounded cross-section having a depth, for example, of 2–5 mm and a width of 10–40 mm. In practice a groove depth of 3 mm and a groove width of 27 mm is preferred, the width of the remaining planar crest-surfaces on either side of the groove being 4 mm.

The upper roll 3 meshes with at least one of the lower rolls 1 and 2 and has arranged circumferentially therearound on bottoms 5′ ridges 9 which engage the aforementioned grooves 8. As will be understood, sufficient clearance is provided between respective co-acting roll surfaces, including the mutually engaging ridges 9 and grooves 8, to enable sheet to be passed through the rolls without damaging the sheet.

As will be seen from FIGS. 1–3, the rolls 2 and 3 are arranged closely adjacent one another, at a distance apart corresponding substantially to the thickness of the through-passing sheet, FIG. 1 being a view seen from the outfeed side of the rolls, taken at right angles to a plane passing through the axes of rolls 2 and 3. The roll 1, on the other hand, is arranged at a given distance from the roll 3. Changes in the vertical setting of the roll 1 result in varying degrees of rounding of the sheet 4 during its passage between the rolls 1,2 and 3.

According to one embodiment, only the upper roll 3 is driven. It will be understood, however, that any number of the rolls may be driven. The number of rolls used may also be greater than three. For example, five rolls or two such roll-clusters similar to the roll-cluster illustrated in FIG. 3 may be used, in which case the first roll cluster forms a shallow bend in the sheet and the other a more pronounced bend.

The rolls are arranged so that at least one roll, and preferably all the rolls 1–3 can be adjusted vertically with the aid of setting screws and bearing blocks or housings which can be moved along substantially vertically extending channels. The direction in which the roll-setting can be adjusted is shown by double-headed arrows 12 in FIG. 3.

In the apparatus according to the invention, the crests 5 of the sheet shown in FIG. 2 are deformed by imprinting continuous grooves on the concave side of the rounded sheet, to produce ribs 10 on the opposite, convex side of the sheet, which further stiffen and reinforce a corrugated sheet rounded in accordance with the invention. The imprinting of the grooves prevents the occurrence of undue stretching on the convex side of the rounded sheet, which could otherwise result in cracking or damage to the sheet, while at the same time advantageously distributing surplus material formed on the concave side of the sheet as it is swaged in the formation of said ribs 10. Otherwise cracks and buckles would be formed. Expressed differently, it can be said that the ribs 10 formed in accordance with the invention not only prevent agglomeration of material on the concave side of the curved sheet, but distribute material to the concave side thereof and also greatly reduce stretching of the material on said convex side, since such stretching is partly the result of resistance on the concave side, this resistance being absent when rounding sheet in accordance with the invention.

Thus, when rounding sheet metal in accordance with the invention, it is possible to work the corrugated sheet with the utmost of care, without causing damage to the same, or to the surface covering thereof in the case of enamelled or painted sheet. In addition hereto, when practicing the present invention, it is possible to round safely relatively thin sheet, for example sheet which has a thickness of 0.5–0.7 mm. In the sheet-rounding phase illustrated in FIG. 3, the leading end of the curved sheet is preferably supported in some suitable manner, for example by lifting or supporting said end with the aid of means suitable herefor, so that the sheet will not bend back under its own weight, as is liable to happen in the case of long sheeting. Such bending can result in a different rounding radius to that desired, or in more serious cases may result in folds and wrinkles of such nature as to render the sheet useless.

The apparatus according to the invention enables sheet to be rounded to practically any radius, particularly to very small radii, and the sheet can readily be rounded to complete a full circle.

Sheet produced in accordance with the invention can be used for many purposes. For example, it can be used as roof-covering material in the construction of such standing structures as cycle-sheds etc., whereby the roofs can be made fully self-supporting, without requiring the assistance of braces, stays or like supports. Sheet formed in accordance with the invention is also able to withstand heavy loads, such as those resulting from snow-falls, storms, high-winds etc.. All that is required is to anchor the free ends or side-edges of the sheets to structural members of the construction in some suitable manner, e.g. with the aid of screws, rivets or like fasteners, so that the sheets according to the invention, due to their intrinsic rigidity and uniformity are able to withstand practically any kind of load to which they may be subjected in practice.

As will be understood, corrugated sheeting produced in accordance with the invention can also be used to construct two-layer roofing structures. In this case, a second corrugated sheet is placed concentrically on the concave side of a first, outer corrugated sheet. It is a simple matter to adapt the rounding or curving radius of the two sheets, since all that is needed is a small adjustment to the distance between the rolls of the bending machine, e.g. the upper roll 3 and the lower rolls 1 and 2. Sheets thus superimposed, one upon the other, may have arranged therebetween supporting profiles, insulating material, etc.. This enables extremely thin sheets to be used and still provide a composite structure of maximum stability, which has the additional feature of being well insulated.

The aforedescribed embodiment illustrated in FIGS. 1–5 of the drawings is not restrictive in any way, but can be modified within the scope of the invention. For example, the invention is not restricted to sheet which exhibits parallel-trapezium shaped corrugations, but can also be applied with sheets of sinusoidal profile, or of any other undulating profile. In addition, in sheets of trapezium profile the transition between crests 5, flanks 6 and bottoms 7 may be rounded instead of sharp. In certain cases the corrugated sheet may even comprise a plastics material instead of metal, in which event provision may be made for heating the rolls and/or for applying heat to the sheet in some other way.

The bending apparatus for rounding corrugated sheet according to the invention need not necessarily be arranged for deflecting the sheet upwards as it is rounded. Thus, the roll assembly illustrated in FIG. 3 can be inverted, i.e. the inverse to that shown in said Figure. This affords certain advantages with regard to supporting of the sheet on the outfeed side of the roll assembly. Such an arrangement of a corrugated sheet rounding machine according to the invention is particularly suitable for rounding short sheets and/or producing curves of large radii.

The first roll 1, whose main purpose is to determine the radius to which a sheet is to be rounded, need not necessarily be provided with circumferentially extending grooves 8. Such grooves are primarily required when the roll 1 is located closely adjacent the roll 3, to obtain pronounced bending of the sheet, and when rounding of the sheet is effected in two stages, i.e. when ribs 10 have already been formed on the trapezium-shaped crests 5 in the first rounding stage.

It can be mentioned that corrugated sheeting produced in accordance with the invention can be stacked and transported with particular ease, and can be readily stood on edge and pushed one along the other, so that any selected number of sheets can be placed together without detriment, for example becoming deformed by bending etc.

FIG. 5 illustrates the profile of a corrugated sheet which has passed through the rolls 1–3. This profile exhibits ribs 10 pressed in the crests 5, the crests being directed towards the concave side of the rounded sheet and the curved crown of the ribs 10 towards the convex side thereof. Remaining on both sides of the ribs 10 are undeformed crest-surfaces 11 of the same form as that possessed by the crests 5 prior to rounding the sheet, in this case a planar form.

FIG. 6 is a side view in larger scale of a sheet according to the invention corresponding to FIG. 5. In FIG. 6 the dimensions of the sheet in the direction of its thickness have been exaggerated, so as better to illustrate the invention.

Figure 7:
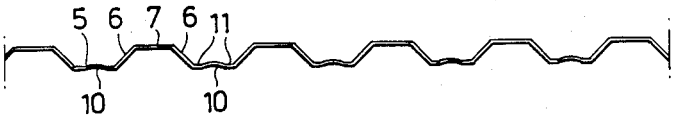
FIGS. 7–9 illustrate various sheet profiles according to the invention.
Figure 8:
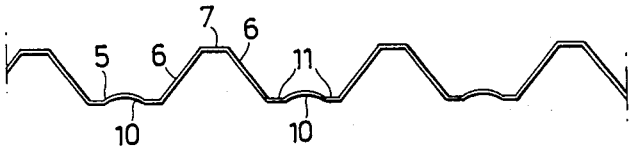
Figure 9:
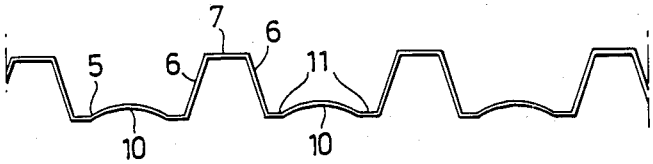

FIGS. 7–9 illustrate, partly in cross-section and partly from said concave side, the profiles of various corrugated sheets, all of which have been rounded in accordance with the invention.

Figure 10:
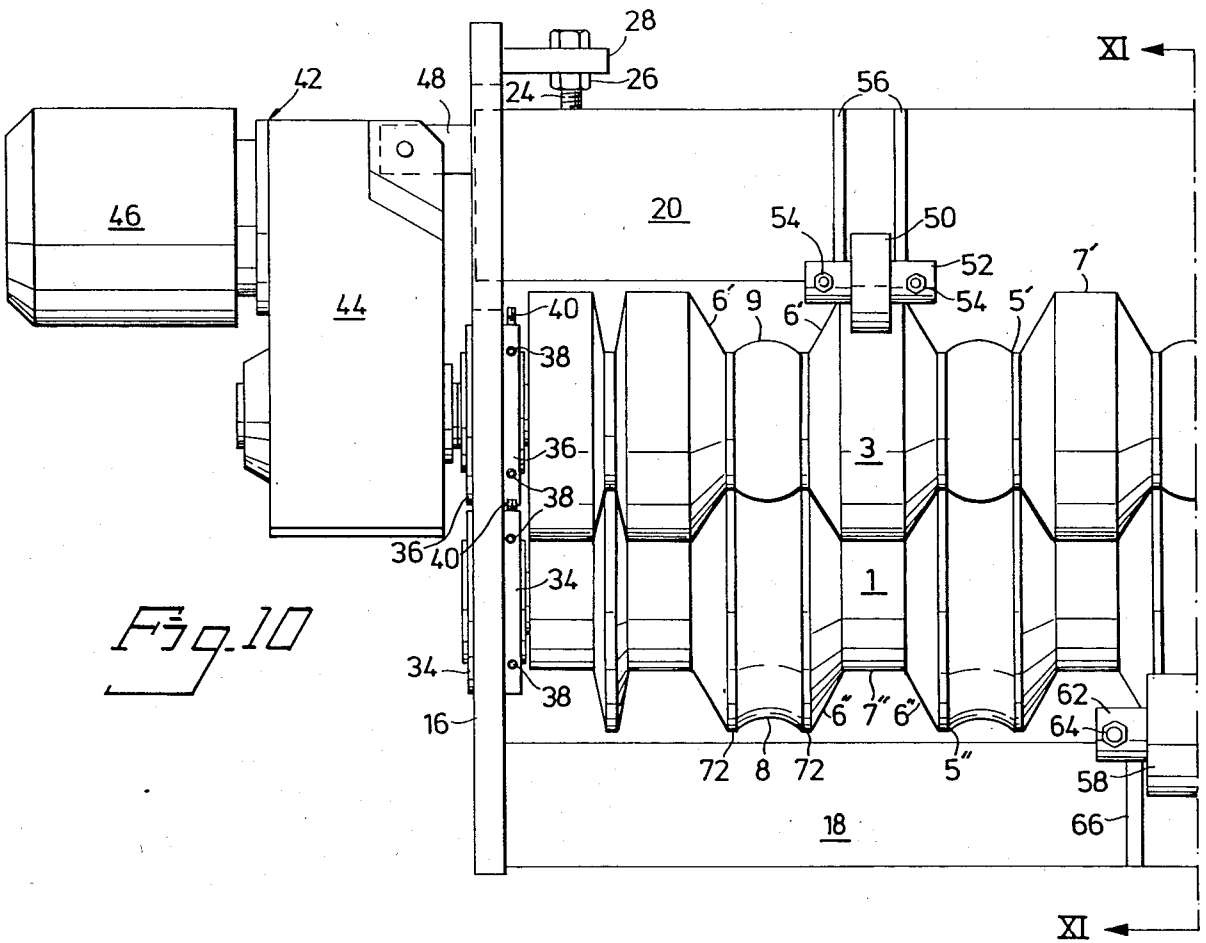
FIG. 10 is a partial end view of a bending machine according to the invention.
Figure 11:
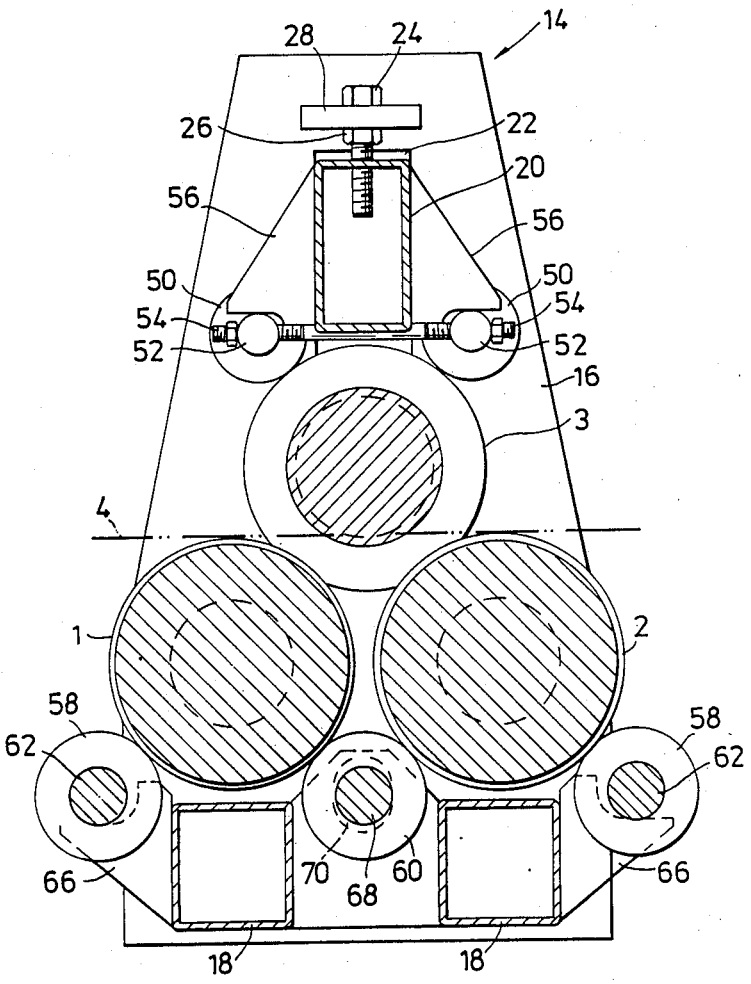
FIG. 11 is cross-sectional view taken along lines XI—XI on FIG. 10.

According to FIGS. 10 and 11 a bending machine according to the invention for rounding corrugated sheet comprises a stand, generally shown at 14, having side walls 16 which are connected together at the bottom regions thereof by two mutually opposite longitudinally extending beams 18. A box-beam 20 is arranged for vertical movement in the upper region of the stand 14, in an elongated groove 22 and can be locked in a desired position in said groove 22 by means of a setting screw 24 and a lock nut 26 cooperating therewith. The setting screw 24 extends through a plain hole located in a lug 28 extending from the top of respective side walls 16 (of which only one is shown) at right-angles thereto, and into a screw-threaded hole provided in the top of the beam 20.

Arranged in the side-walls 16 of the stand 14 are seats for bearing blocks or housings 34,36 of respective rolls 1,2 and 3. Each of the bearing blocks 34,36 is provided with horizontal setting screws 38 and vertical setting screws 40. The need for making adjustments to the roll settings may vary in dependence upon the design of the machine. For example, the possibility of making vertical adjustments may only be necessary with respect to the upper bearing block 36, while the need for horizontal adjustments may only apply to the lower bearing blocks 34.

In the illustrated embodiment, the upper roll 3 is driven by a drive means 42 comprising a shaft-mounted gear 44 and a gear motor 46. The pull-rod (not shown) of the gear 44 is attached to a lug 48 located on one side-wall 16.

When rounding of the sheet can be effected without placing undue strain thereon, it may be sufficient to adjustably support the rolls solely at the side-walls 16 of the stand 14. When rounding of the sheet requires more strenuous efforts, however, supporting rolls can be provided to counter-act any tendency of the rolls to bow outwards at their centre regions. FIG. 10 is an illustrative view of a bending machine according to the invention cut along a vertical centre line. The upper, driven roll 3 is supported by two pairs of supporting rolls 50, while the lower rolls 1 and 2 are supported by a pair of supporting rolls 58. The upper supporting rolls 50 are journalled on horizontal shafts 52, the setting of which can be adjusted horizontally by means of setting screws 54. The shafts 52 are secured in their selected vertical position by means of brackets 56 mounted on the beam 20.

When the supporting rolls 50 press against the roll 3, they will be forced outwards towards the adjusting nuts 54′ of the setting screws 54. The supporting rolls 50 can then be brought to bear with the requisite force against the upper roll 3, by tightening the nuts 54′ to set the vertical position of the upper roll 3. The position of the supporting rolls 50 can be set roughly with the aid of the aforesaid setting screw 24 used to set the vertical position of the beam 20.

The lower rolls 1 and 2 of the illustrated roll assembly are supported centrally by the two outer supporting rolls 58 and by a further supporting roll 60 located therebetween. This central supporting roll 60 is common to supporting rolls. The outer supporting rolls 58 are journalled on horizontal shafts 62, the setting of which can be adjusted horizontally with the aid of setting screws 64 and attachment brackets 66 on the beams 18 (FIG. 10). The central supporting roll 60 is mounted on a roll-shaft 68, which is arranged for vertical adjustment in a groove 70, by means of setting screws (not shown). In the embodiment illustrated in FIGS. 10 and 11, provision is primarily made for adjustments to the lower rolls 1,2 in the horizontal direction. Although in the embodiment illustrated in FIGS. 10 and 11, the setting of the beam 20 is secured by means of the setting screws 24, it will be understood that other means suitable herefor can be used instead. For example, the setting screws can be replaced with a lever-arm mechanism so designed as to permit very fine adjustments to be made to the setting of the beam. Moreover, the beam can be mounted for horizontal movement in addition to the illustrated and described vertical movement. The setting screws can be manipulated during a sheet rounding operation, to produce shapes other than part circular.

As beforementioned, the embodiment illustrated in FIGS. 10 and 11 merely represents an example of a bending machine constructed in accordance with the invention. The various components of the bending machine may have any desired size, and the roll-bearing blocks and their position adjusting means may have a design different to that described and illustrated. For example, the bearing blocks may have large dimensions and the means for adjusting the setting of the blocks may be arranged to co-act in a suitable fashion with the machine stand, primarily with the side-walls thereof.

The supporting rolls 58,60 must have a width which corresponds to the whole of the crest-surface 5, so that the rolls are able to abut non-deformed outer planar parts 72 of the crest-surface, these planar parts corresponding to residual, non-deformed crest surfaces 11 on the rounded sheet. The supporting rolls 50, on the other hand, abut against planar surfaces and can be made narrower or axially shorter than rolls 58 and 60. Alternatively, the diameter of the supporting rolls can be so large that they bear against a bottom 7 instead.

I claim:

1. A rounded or longitudinally curved corrugated sheet having a concave side within said longitudinal curve and an opposite convex side, comprising a series of adjacent generally U-shaped portions each having an exterior and an interior, said series of adjacent generally U-shaped portions extending parallel to one another and each said U-shaped portion being defined by diverging flanks (6) having proximal edges connected by a bottoms surface (5), said flanks also having distal edges, said U-shaped portions being joined to adjacent U-shaped portions by generally planar crests (7) extending between distal edges of the said flanks (6), said bottom surfaces lying along the concave side of said sheet and said crests lying along the convex side of said sheet;

each of said bottom surfaces (5) having a continuous longitudinal groove with a rounded cross sectional shape pressed therein from said exterior, and each said groove occupying substantially the entire transverse width of its bottom surface to form a rounded rib (10) on the interior of the U-shaped portion;

said grooves being formed in a flat, corrugated sheet during a bending operation giving said sheet its rounded shape, said crests (7) and flanks (6) retaining their original shapes during said bending operation without being altered or deformed.

2. A rounded corrugated sheet according to claim 1, wherein said grooves have a shallow cross-sectional profile.

3. A rounded corrugated sheet according to claim 1, wherein the depth of the grooves is 2–5 mm and the width is 10–40 mm.

4. A rounded corrugated sheet in accordance with claim 1, wherein the depth of the grooves is about 3 mm and the width is about 27 mm.

5. A rounded corrugated sheet according to claim 1, wherein said generally U-shaped portions with said diverging flanks are generally trapezoidal in cross section.

6. A rounded corrugated sheet according to claim 1 of metal having a thickness of 0.5–0.7 mm.

7. A method for the production of a rounded corrugated sheet according to claim 1, comprising:

feeding a flat, corrugated sheet (4) with its corrugations extending longitudinally, past a first configured roll (1) and into a nip formed between a pair of profile rolls (2, 3) with complementary, circumferentially extending bottom surface engaging portions and circumferentially extending crest engaging portions for the respective passage therethrough of the bottom and crests of the corrugated sheet, said rolls forming a curved passageway for the sheet (4);

said pair of rolls (2,3) having a shape corresponding to the initial corrugation profile of said sheet (4) except that said bottom surface engaging roll (2) of said pair of rolls (2,3) has continuous circumferential depressions (8) and the other roll (3) of said rolls has a complementary matching continuous circumferential ridges (9);

the sheet (4) during its passage through said rolls being bent to a rounded shape;

said continuous circumferential despressions (8) and ridges (9) deforming the bottom surfaces (5) of said sheet (4) during passage of said sheet through said rolls by imprinting continuous grooves on the concave side of said sheet to produce ribs (10) on the concave side of the sheet while at the same time distributing surplus material formed on the concave side of the sheet as it is swaged in the formation of said ribs (10); and maintaining the flanks (6) and crests (7) without any deformation or change in profile shape during passage through said rolls.

8. A method according to claim 7 comprising lifting the downstream end of the sheet as it emerges from said rolls to prevent re-bending thereof.

9. A method according to claim 7 comprising adjusting at least one of said rolls to control and obtain a desired radius of curvature.

* * * * *